United States Patent [19]

Kobayashi et al.

[11] Patent Number: 4,633,613

[45] Date of Patent: Jan. 6, 1987

[54] WINDOW REGULATOR FOR DOOR

[75] Inventors: Fumio Kobayashi, Ayase; Jun Yamagishi, Yokohama, both of Japan

[73] Assignee: Ohi Seisakusho Co., Ltd., Yokohama, Japan

[21] Appl. No.: 679,274

[22] Filed: Dec. 7, 1984

[30] Foreign Application Priority Data

Dec. 9, 1983 [JP] Japan ..... 58-231489
Mar. 28, 1984 [JP] Japan ..... 59-43227[U]

[51] Int. Cl.[4] ..... E05F 11/52
[52] U.S. Cl. ..... 49/227; 49/352
[58] Field of Search ..... 49/352, 227, 360

[56] References Cited

U.S. PATENT DOCUMENTS 3,281,991 11/1966 Colell ..... 49/352
3,646,707 3/1972 Lystad ..... 49/227
4,109,417 8/1978 Fogarollo ..... 49/352
4,335,541 6/1982 Kazewych ..... 49/352 X
4,440,354 4/1984 Kobayashi et al. ..... 49/352 X
4,442,632 4/1984 Greco et al. ..... 49/352
4,502,247 3/1985 Kobayashi et al. ..... 49/352

*Primary Examiner*—Philip C. Kannan
*Attorney, Agent, or Firm*—Schwartz, Jeffery, Schwaab, Mack, Blumenthal & Evans

[57] ABSTRACT

In a vehicle door having a retractable window pane, there is provided an improved window regulator for moving the window pane between its full-open position and its full-closed position. The window regulator comprises an elongate plate secured to the door, the plate being formed with at least one guide rail which extends obliquely, at least one slider slidably engaged with the guide rail, a carrier secured to the window pane and mounting thereon the slider, so that the movement of the slider along the guide rail induces the movement of the window pane, guide means permitting the window pane to pivot during the movement of the same, a flexible wire connected at a portion thereof to the carrier, so that the movement of the wire induces the movement of the carrier and thus the window pane, and a drive unit mounted to the door for driving the wire.

18 Claims, 24 Drawing Figures

WINDOW REGULATOR FOR DOOR

BACKGROUND OF THE INVENTION

1. Field of the Invention

The present invention relates to a window regulator for doors, particularly side doors for motor vehicles, by which regulator the window pane of the door is moved between its full-open position and its full-closed position.

2. Description of the Prior Art

In order to move the window pane of a door between its full-open position and its full-closed position, various kinds of window regulators have been hitherto proposed and put into practical use. However, due to their inherent constructions, some of the conventional window regulators fail to exhibit their calculated functions. Viz., as will become apparent as the description proceeds, some of them are bulky and heavy in construction, and thus when mounted in the door, they tend to induce bulky and heavy construction of the door assembly. Such construction deteriorates not only the external appearance of the vehicle but also the fuel consumption of the same.

SUMMARY OF THE INVENTION

Accordingly, it is an essential object of the present invention to provide an improved window regulator which is simple in construction and light in weight.

It is another object of the present invention to provide a window regulator which assures smooth movement of the window pane between the full-open and full-closed positions.

According to the present invention, there is provided a window regulator in a door having a retractable window pane which moves between its full-open position and its full-closed position, the window regulator comprising an elongate plate secured to the door, the plate being formed with a first guide rail which extends therealong, a first slider slidably engaged with the first guide rail so that it runs along the rail, a carrier secured to the window pane and mounting thereon the first slider, so that the movement of the first slider along the first guide rail induces the movement of the window pane between the full-open and full-closed positions, guide means permitting the window pane to pivot during the movement of the same, a flexible wire connected at a portion thereof to the carrier so that the movement of the wire therealong induces the movement of the carrier, and a drive unit mounted to the door for moving the wire therealong.

DETAILED DESCRIPTION OF THE DRAWINGS

Other objects and advantages of the present invention will become apparent from the following description when taken in conjunction with the accompanying drawings, in which.

DESCRIPTION OF CONVENTIONAL WINDOW REGULATOR

Figure 1:
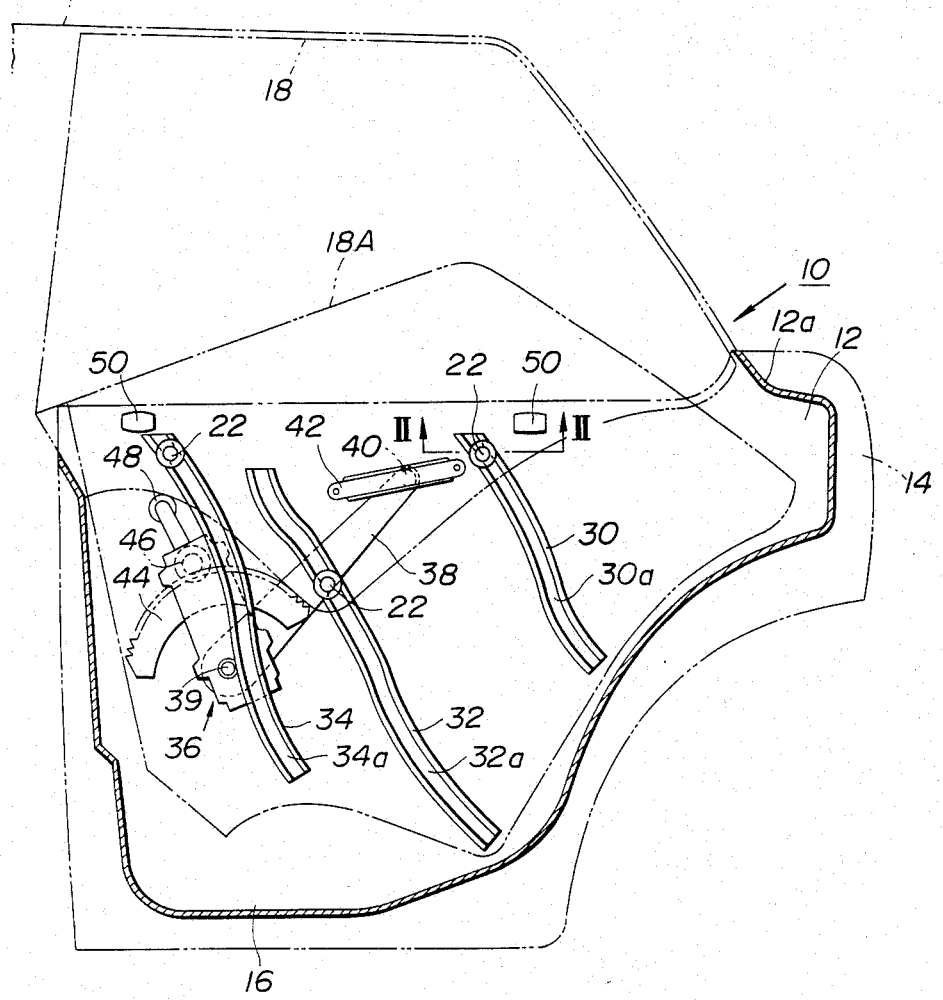
FIG.1 (PRIOR ART)
FIG. 1 is a vertically sectional view of a vehicle door which mounts therein a conventional window regulator.
Figure 2:
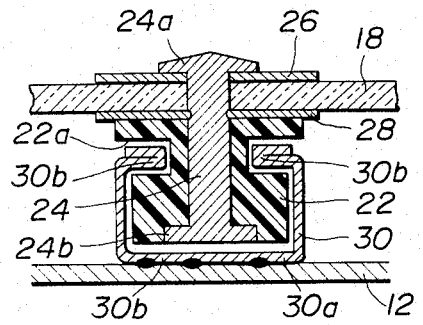
FIG.2 (PRIOR ART)
FIG. 2 is an enlarged sectional view taken along the line II—II of FIG. 1.

Prior to describing in detail the present invention, one conventional window regulator will be outlined with reference to FIGS. 1 and 2 in order to clarify the invention.

Referring to FIGS. 1 and 2, particularly FIG. 1, there is shown a prior art window regulator which is mounted in a rear-left door of a motor vehicle. The view of FIG. 1 is illustrated from the outside of the vehicle. The door 10 shown comprises generally an inner panel 12, an outer panel 14 and a flange portion 12*a* of the inner panel 12 which are combined together to form in the door proper a glass pane containing structure 16 into which a glass pane 18 is insertable. Designated by numeral 20 is a window opening which is defined between a vehicle body and the door 10 in closed condition. The window opening 20 can be closed by the glass pane 18 which is raised from the containing structure 16 of the door 10.

The conventional window regulator practically applied to the door 10 has such a construction as is described hereinnext. Three guide rollers 22 are connected to the lower spaced portions of the glass pane 18, each being rotatable about an axis which is perpendicular to the major surface of the pane 18. As will be understood from FIG. 2, each roller 22 is thus journaled on a shaft 24 which is fixed to the glass pane 18 together with two reinforcing plates 26 and 28 by which the pane 18 is sandwiched. For assured connection of the roller 22 to the pane 18, the shaft 24 has both ends 24*a* and 24*b* enlarged, as shown. Three gently curved guide rails 30, 32 and 34, each having a generally C-shaped cross section, are secured at their base portions 30*a*, 32*a* and 34*a* to the inner panel 12 and extend downwardly and obliquely but nonparallely as is seen from FIG. 1. As is seen from FIG. 2, each roller 22 is formed with an annular groove 22*a*. Upon assembly, the three guide rollers 22 are received by the corresponding guide rails 30, 32 and 34 in such a manner that opposed edges 30*b* of each guide rail 30, 32 or 34 are inserted into the annular groove 22*a* of the associated guide roller 22. With this, the upward and downward movements of the glass pane 18 are carried out by the rollers 22 which run along and are guided by the corresponding guide rails 30, 32 and 34.

A driving mechanism 36 is provided which drives the glass pane 18 to carry out the upward and downward movements of the same. The mechanism 36 comprises an elongate arm 38 which has a lower end pivoted by a pivot pin 39 to the inner panel 12 and an upper end equipped with a roller 40. The roller 40 is movably received in a straight guide rail 42 which is attached to the glass pane 18. A sector gear 44 is fixed at its one (right) end to the arm 38 to move therewith. A pinion 46 is engaged with the sector gear 44 and disposed on a shaft portion of a manual handle 48 which is exposed to the passenger cabin of the vehicle.

Designated by numeral 50 are rollers which are rotatably mounted on the upper portion of the inner panel 12 and rotatably contact the inside surface of the glass pane 18 to prevent or at least minimize lateral play of the same during upward and downward movements of the glass pane 18.

When the manual handle 48 is rotated counterclockwise in FIG. 1, the sector gear 44 and thus the arm 38 pivot about the pivot pin 39 in the clockwise direction. With this, the glass pane 18 is moved downward swinging counterclockwise to the position indicated by numeral 18A, that is, to the full-open position of the glass pane 18.

However, the conventional window regulators of the type described hereinabove have the following drawbacks due to their inherent constructions. That is, usage of the elongate arm 38 and the sector gear 44 as part of the driving mechanism 36 induces bulky and heavy construction of the window regulator, so that construction and weight of the door assembly are inevitably increased deteriorating not only the external appearance of the vehicle but also the fuel consumption of the same. Further, assembly of the window regulator to the door and pre-adjusting work of such an assembly are considerably troublesome. Furthermore, usage of such heavy and bulky parts in the driving mechanism 36 inevitably increases the operating force with which an operator or passenger in the vehicle manipulates the manual handle 48.

DETAILED DESCRIPTION OF THE INVENTION

Therefore, to provide an improved window regulator which is free of the above-mentioned drawbacks is an essential object of the present invention.

Figure 3:
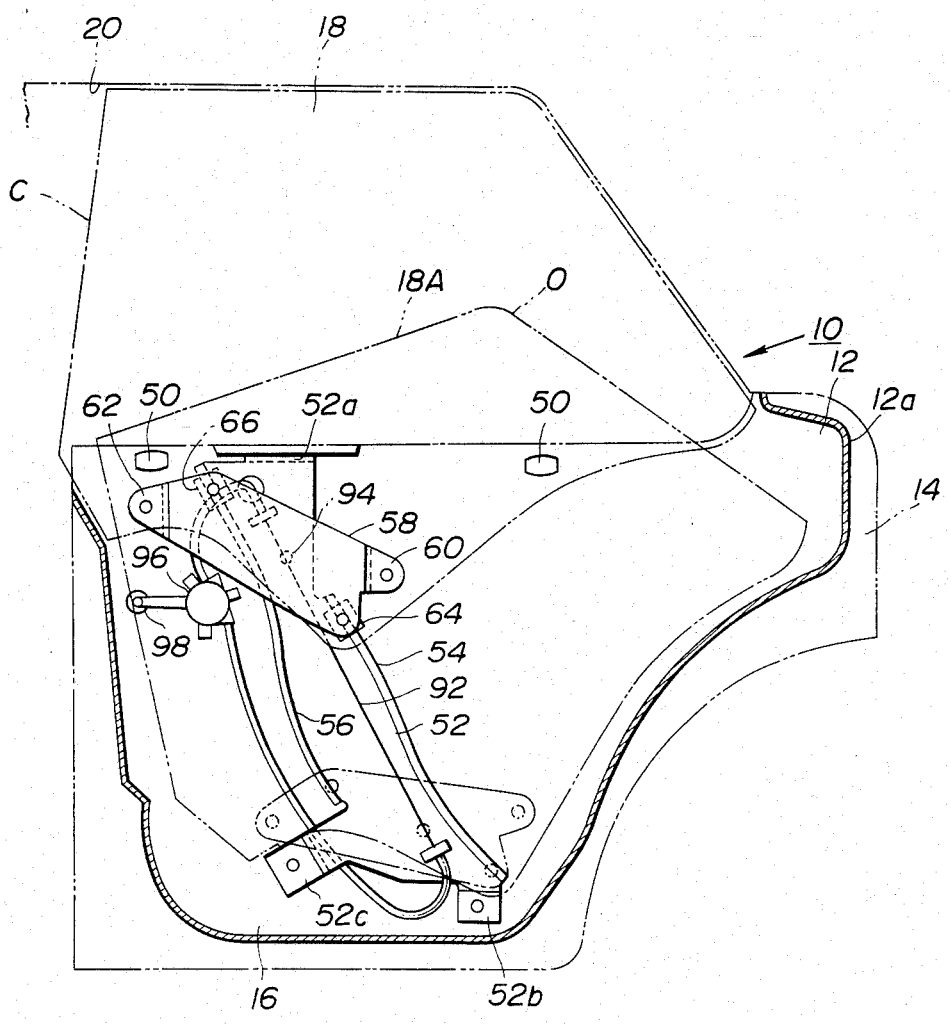
FIG. 3 is a view similar to FIG. 1, but showing a first embodiment of the present invention.
Figure 4:
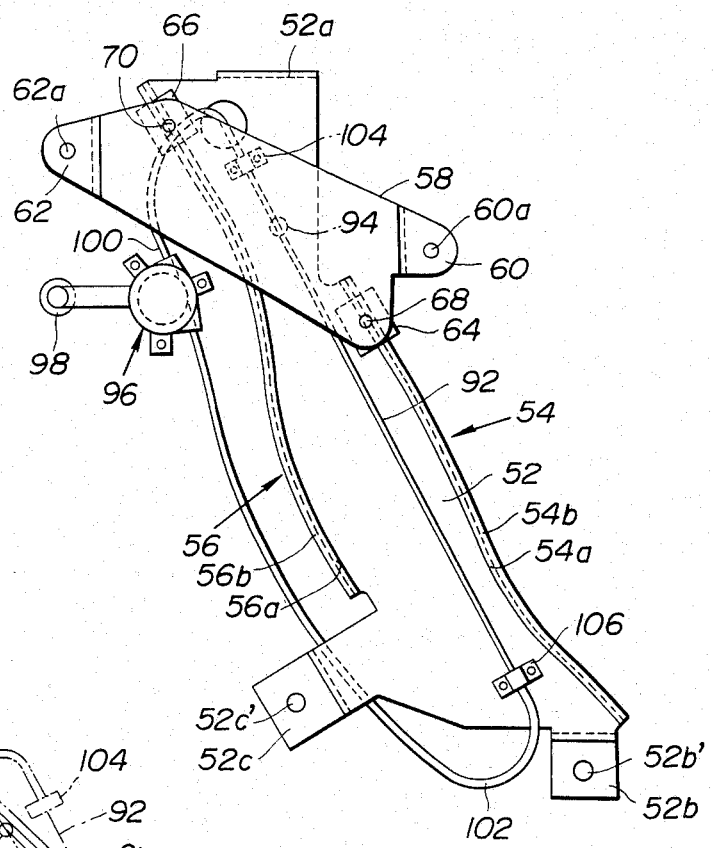
FIG. 4 is an enlarged view of a window regulator employed in the first embodiment of the present invention.

Referring to FIGS. 3 to 9, particularly FIGS. 3 and 4, there is shown a window regulator of a first embodiment of the present invention, which is mounted in a rear-left door of a motor vehicle. The door shown has substantially the same construction as that of FIG. 1. Thus, the parts of the door 10 are designated by the same numerals.

The window regulator of this embodiment comprises an elongate plate 52 which is mounted to the inner panel 12 and extends downwardly and obliquely, as shown. For this mounting, the elongate plate 52 is formed with three lugs 52*a*, 52*b* and 52*c* which are bolted to the inner panel 12. Bolt holes formed in the lugs 52*b* and 52*c* are designated by numerals 52*b*′ and 52*c*′ in FIG. 4. As is best seen from FIG. 4, the elongate plate 52 is formed at its lateral sides with first and second guide rails 54 and 56 which extend along the corresponding sides of the plate 52. As is understood from FIG. 6, each guide rail 54 (or 56) comprises a first section 54*a* (or 56*a*) raised perpendicularly from the major portion of the elongate plate 52 and a second section 54*b* (or 56*b*) extending perpendicularly outwardly from the first section 54*a* (or 56*a*), so that the guide rail 54 (or 56) has a generally L-shaped cross section. As is seen from FIG. 4, the guide rails 54 and 56 are gently curved and they are nonparallel.

Guided by the guide rails 54 and 56 is a glass pane carrier 58 which is attached or bolted to the lower portion of the glass pane 18. For this attachement, the carrier 58 has at its longitudinal bent ends 60 and 62 bolt holes 60*a* and 62*a* through which bolts (not shown) pass. The carrier 58 is equipped at its right-lower and left-upper portions with respective sliders 64 and 66 which are slidably engaged with the first and second guide rails 54 and 56 in a manner as will be described hereinafter. As is seen from FIG. 6, each slider 64 (or 66) is pivotally connected to the carrier 58 through a connecting pin 68 (or 70).

The detailed construction of the slider 64 (or 66) will be described hereinnext with reference to FIG. 9. As the sliders 64 and 66 have substantially the same constructions, the following explanation will be directed to only one slider, that is, the slider 64.

The slider 64 comprises generally a rectangular casing 72 and a plastic slide shoe 74 which is housed in the casing 72. The casing 72 is formed at its bottom portion with a circular opening 76 through which the connecting pin 68 passes. The pin 68 is caulked at the leading end thereof for the pivotal connection with the carrier 58 (see FIG. 6). The casing 72 is formed with a vertical slot 78 which receives the first section 54*a* of the guide rail 54 during movement of the carrier 58 as will become clear as the description proceeds.

Figure 9:
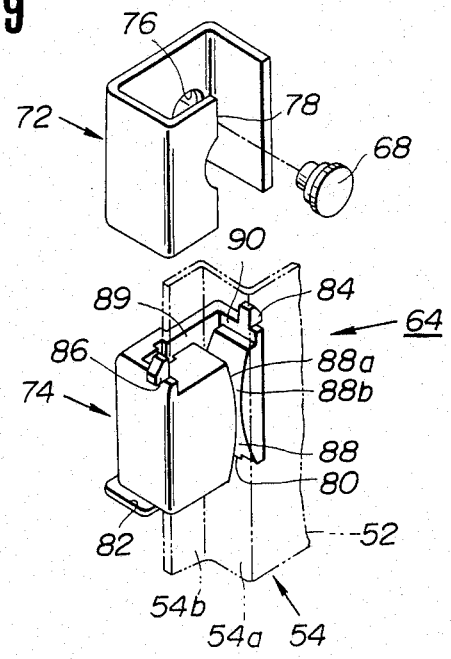
FIG. 9 is a perspective view of the slider in disassembled condition.

The plastic slide shoe 74 is of a generally rectangular construction and has at its lower portion in FIG. 9 two outwardly extending lugs 80 and 82 and at its upper portion two bosses 84 and 86. Each boss 84 or 86 is formed with a slanted surface (no numeral). The plastic slide shoe 74 is formed with a vertically extending slit 88 which is defined between opposed convex surfaces 88*a* and 88*b*, and the shoe 74 is further formed with a generally rectangular slot 89 which intersects the slit 88 at substantially right angle, as shown. The upper portion of the plastic shoe 74 is formed with a rectangular recess 90 which is merged with the slot 89 and the slit 88 as shown. Upon requirement of assembly, the bosses 84 and 86 of the shoe 74 are pressed toward each other and inserted into the casing 72 from the lower open end of the same and moved until they are sprung out the upper open end of the casing 72. Thus, upon proper assembly, the lugs 80 and 82 of the shoe 74 and the bosses 84 and 86 of the same are hooked to the lower and upper edges of the casing 72 respectively with the vertical slit 88 exposed to the vertical slot 78 of the casing 72. With this, the plastic slide shoe 74 is locked in the casing 72. The assembled condition of the slider 64 may be understood from FIGS. 7 and 8 even though the slider 64 shown in these drawings is illustrated upside-down with respect to FIG. 9. As may be understood from FIG. 9, upon assembly of the slider 64 to the guide rail 54, the first section 54*a* and the second section 54*b* of the guide rail 54 are slidably received in the slit 88 and the slot 89 respectively. As is understood from FIG. 7, the narrowest portion of the slit 88 of the shoe 74 is positioned on or at least near the axis of the connecting pin 68, and one side 89*a* of the slot 89 of the shoe 74 which faces the edge of the second section 54*b* of the guide rail 54 is convexed toward the axis of the connecting pin 68. With these convex surfaces 88*a*, 88*b* and 89*a* of the slit 88 and the slot 89, the sliding movement of the slider 64 along the guide rail 54 is carried out permitting pivotal movement thereof about the axis of the pin 68. As is understood from FIG. 8, opposed major surfaces 89*b* and 89*c* of the slot 89 of the shoe 74, which face the surfaces of the second section 54*b* of the guide rail 54, are convexed toward each other. With these convex surfaces 89*b* and 89*c* of the slot 89, the sliding movement of the slider 64 is carried out permitting pivotal movement thereof about an axis perpendicular to the axis of the connecting pin 68. Accordingly, the sliding movement of the slider 64 is carried out permitting universal swing thereof relative to the guide rail 54.

The other slider 66 having the same construction as the just-mentioned slider 64 runs along the second guide rail 56 in substantially the same manner as that just described.

Referring back to FIG. 4, a flexible wire 92 is fixed at a portion thereof through a connector 94 to the carrier 58. Both ends of the wire 92 lead to a known wire retractor 96 which is mounted to the inner panel 12 and driven by a manual handle 98 exposed to the passenger cabin of the vehicle. The wire retractor 96 is designed to retract and draw out the respective end portions of the wire 92 at the same rate without producing slack or abnormal tension of the wire. Two guide tubes 100 and 102 receive therein the wire 92 and are fixed through respective connectors 104 and 106 to the upper and lower portions of the elongate plate 52, each leading to the wire retractor 96. Thus, upon manipulation of the manual handle 98, the wire 92 travels and thus the carrier 58 moves downward or upward but obliquely while keeping the slidable engagement of the sliders 64 and 66 with the first and second guide rails 54 and 56, as will be described in detail hereinnext.

Figure 5:
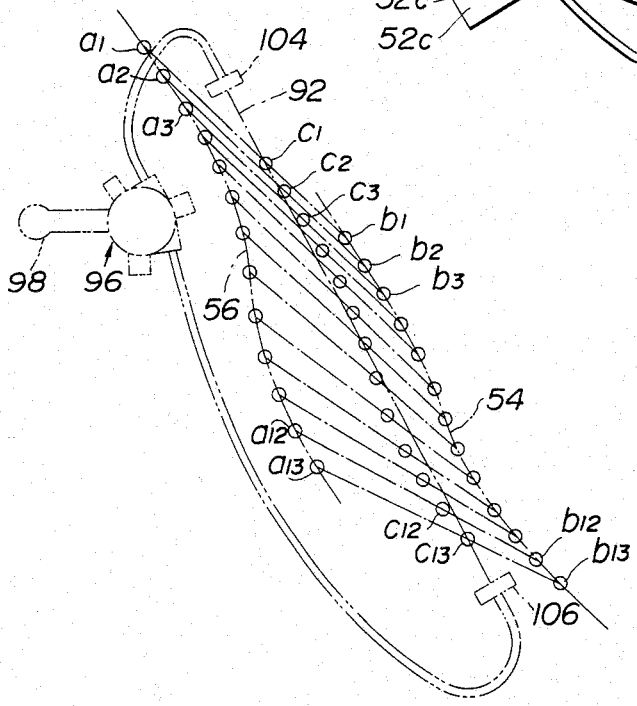
FIG. 5 is an illustration showing respective pathes swept out by two sliders and a wire connector which are connected to a glass pane carrier.
Figure 6:
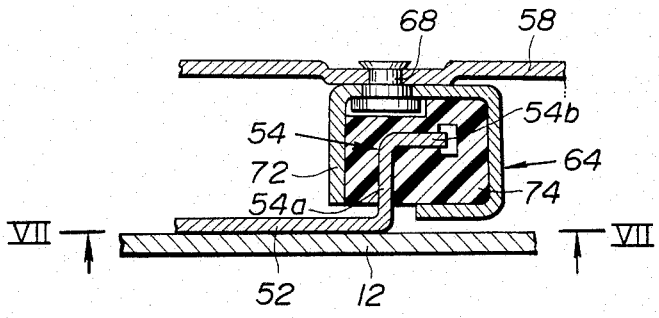
FIG. 6 is a horizontally sectional view of the slider.
Figure 7:
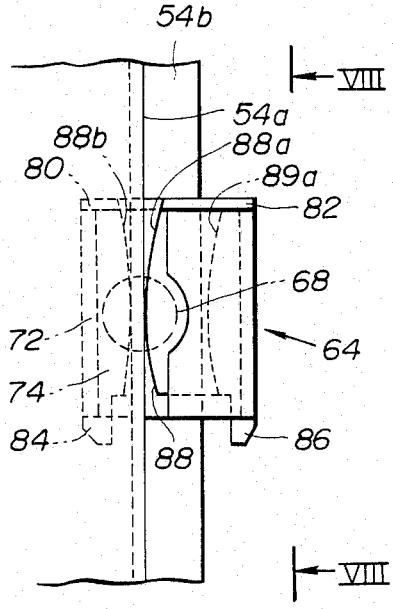
FIG. 7 is a view taken from the direction of the line VII—VII of FIG. 6.
Figure 8:
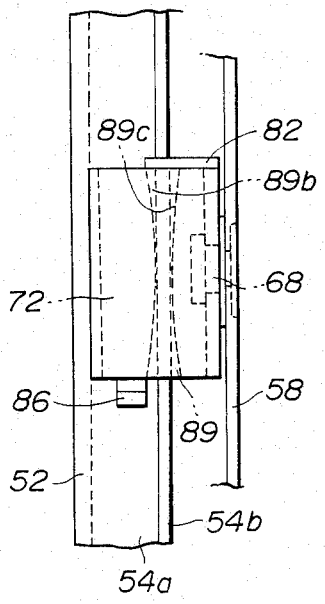
FIG. 8 is a view taken from the direction of the line VIII—VIII of FIG. 7.

In the following, operation of the window regulator of the first embodiment will be described with reference to FIGS. 3, 4 and 5. For ease with which the description is made, it will be commenced with respect to the condition of FIG. 4 wherein the glass pane carrier 58 is in its uppermost position, that is, the glass pane 18 is in its full-closed position. As will be seen from FIG. 5, under this closed condition, the two sliders 66 and 64 assume their uppermost positions $a_1$ and $b_1$ on the second and first guide rails 56 and 54, and the wire connector 94 assumes its uppermost position $c_1$.

When the carrier 58 moves downward in response to manipulation of the manual handle 98, the two sliders 66 and 64 move downward toward their lowermost positions $a_{13}$ and $b_{13}$ on the second and first guide rails 56 and 54 while being guided by the same. During this downward movement of the carrier 58, the wire connector 94 moves toward its lowermost position $c_{13}$ passing the positions $c_2$, $c_3$, . . . $c_{12}$. It is to be noted that any line which connects an evenly divided point (for example $a_3$) of the path extending from the point $a_1$ to the point $a_{13}$ and an evenly divided corresponding point (for example $b_3$) of the path extending from the point $b_1$ to the point $b_{13}$ passes through or at least near the position (for example $c_3$) where the wire connector 94 assumes during the movement of the carrier 58. This is important to achieve smooth or tangleless movement of the carrier 58. That is, by this arrangement, the carrier 58 can move without producing slack of the wire 92 and excessive tension of the same. Due to the curved construction of the first and second guide rails 54 and 56, the downward movement of the carrier 58 induces simultaneous but small swing of the carrier 58 in the counterclockwise direction in FIG. 4. That is, as is seen in FIG. 3, the glass pane 18 is moved from its full-closed position indicated by mark "C" to its full-open position indicated by mark "O" while swinging counterclockwise. Under the full-open position of the glass pane 18, it is housed in the glass pane containing structure 16, as shown.

Figure 10:
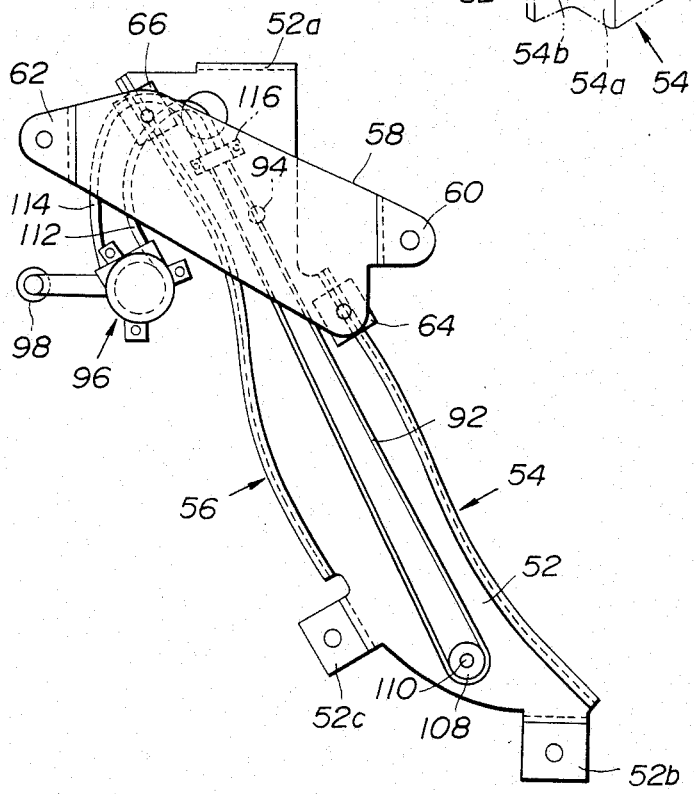
FIG. 10 is a view similar to FIG. 4, but showing a second embodiment of the present invention.

Referring to FIG. 10, there is shown a second embodiment of the present invention. The window regulator of this embodiment is identical to that of the aforementioned first embodiment except for the arrangement of the wire 92.

In the second embodiment, a pulley 108 is rotataly connected through a shaft 110 to the lower portion of the guide rail-mounted elongate plate 52. A flexible wire 92 is put around the pulley 108. A portion of the wire 92 is fixed through a connector 94 to the glass pane carrier 58. Both ends of the wire 92 lead to the wire retractor 96. Two guide tubes 112 and 114 which slidably receive therein the wire 92 are fixed through a common connector 116 to the elongate plate 52, each leading to the wire retractor 96, as shown. Since the operation of this second embodiment is substantially the same as the afore-mentioned first embodiment, the description of it will be omitted.

Figure 11:
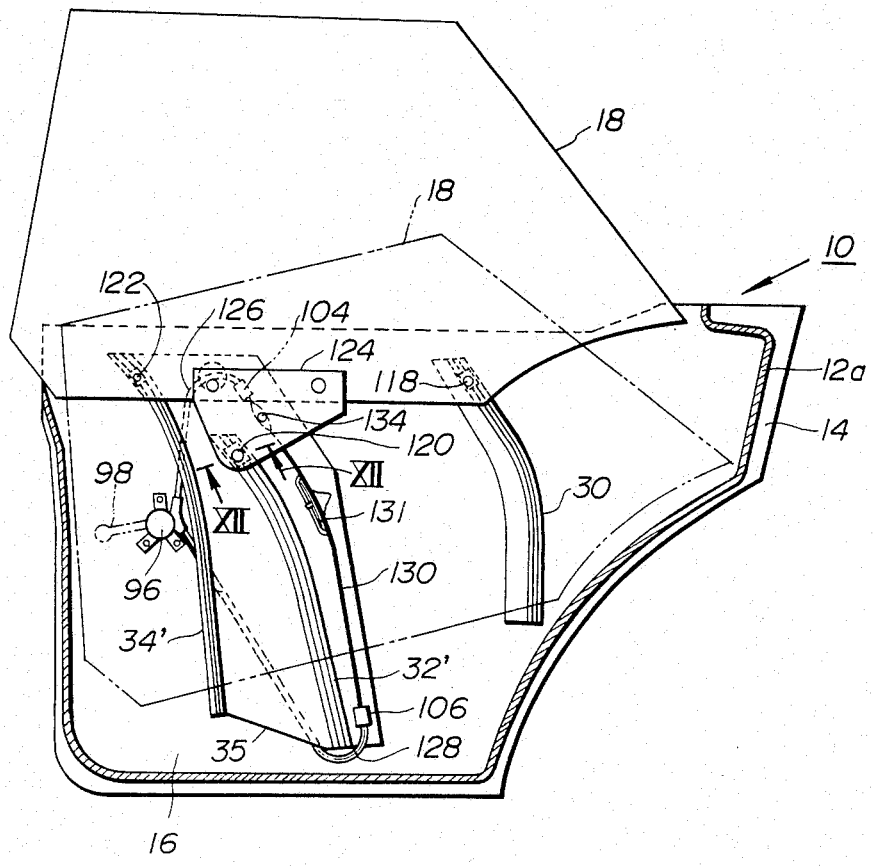
FIG. 11 is a vertically sectional view of a vehicle door which mounts therein a window regulator of a third embodiment of the present invention.

Referring to FIGS. 11 to 19, particularly FIG. 11, there is shown a window regulator of a third embodiment of the present invention, which is also mounted in a rear-left door of a motor vehicle. The door 10 shown comprises generally an inner panel (not shown), an outer panel 14 and a flange 12*a* of the inner panel which are assembled together to form in the door 10 a glass pane containing structure 16 into which the glass pane 18 is insertable.

The window regulator of the third embodiment comprises three gently curved guide rails 30, 32' and 34' which are connected to the inner panel of the door 10 and extend downwardly, obliquely and nonparallelly, as shown. The guide rails 32' and 34' are integrally formed on a common plate 35 which is secured to the inner panel. Three sliders 118, 120 and 122 are slidably received in the guide rails 30, 32' and 34' in such a manner as will be understood from FIG. 12 which shows the slider 120 associated with the guide rail 32'. As is seen from FIG. 11, the right and left sliders 118 and 122 are directly fixed to the lower portion of the glass pane 18, while the center slider 120 is fixed to a glass pane carrier 124 which is bolted to the lower portion of the glass pane 18. A flexible wire 130 is connected at a portion thereof to the carrier 124 by a connector 132. Both ends of the wire 130 lead to the known wire retractor 96 which is mounted to the inner panel of the door 10 and driven by a manual handle 98 exposed to the passenger cabin of the vehicle. Two guide tubes 126 and 128 cover partially the wire 130 and lead to the retractor 96. Each tube 126 or 128 is connected through a connector 104 or 106 to the plate 35. Designated by numeral 131 is a guide member which is secured to the plate 35 for guiding the movement of the wire 130. Thus, upon manipulation of the manual handle 98, the carrier 124 moves downward or upward but obliquely while keeping the sliding engagement between the sliders 118, 120 and 122 and the corresponding guide rails 30, 32' and 34', similar to the cases of the abovementioned two embodiments.

The sliding mechanism comprising the slider 120 and the guide rail 32' has such a construction as is described hereinnext with reference to FIGS. 12 to 18. The other two sliding mechanisms each comprising the slider 118 or 122 and the corresponding guide rail 30 or 34' are substantially the same as the hereinnext described one. Thus, description of them will be omitted from the following.

Figure 12:
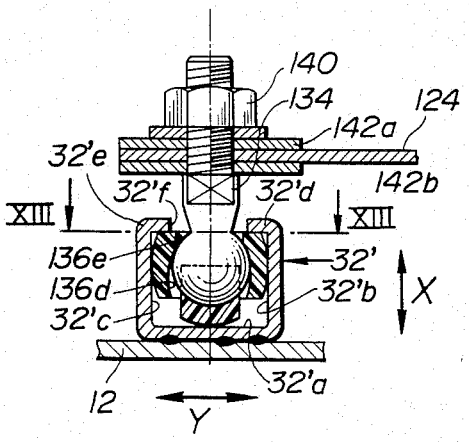
FIG. 12 is an enlarged a sectional view taken along the line XII—XII of FIG. 11, showing a slider operatively received in a guide rail.

As is seen from FIG. 12, the guide rail 32' has a generally C-shaped cross section and thus comprises a base truck 32'a, opposed side trucks 32'b and 32'c and opposed flanges 32'd and 32'e, as shown. The opposed flanges are constructed to define therebetween a longitudinally extending slot 32'f. In this drawing, the arrows X and Y indicate the directions of the width and length of the associated vehicle respectively.

Figure 15:
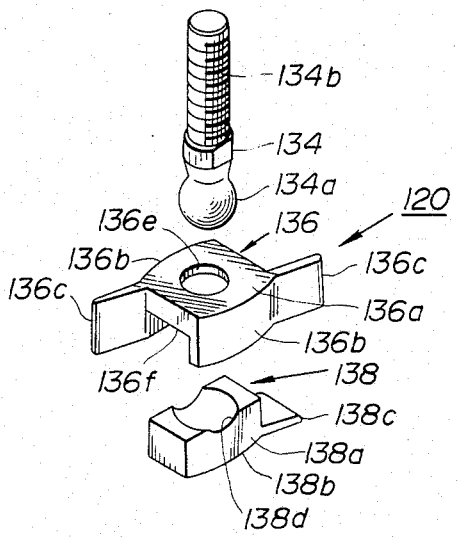
FIG. 15 is an exploded view of the slider employed in the third embodiment.
Figure 16:
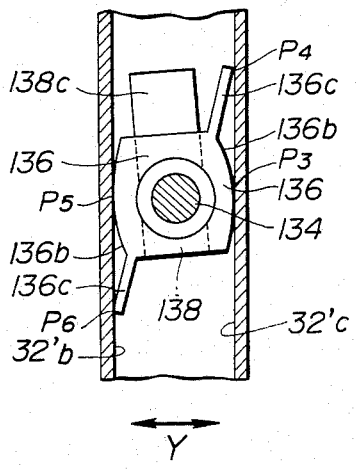
FIGS. 16 and 17 are sectional views similar to FIGS. 13 and 14, but showing a condition wherein the slider is applied with an external force during movement along the guide rail.
Figure 17:
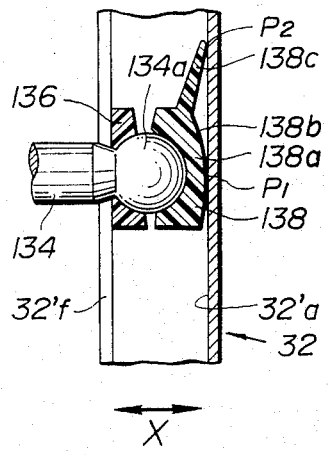
Figure 18:
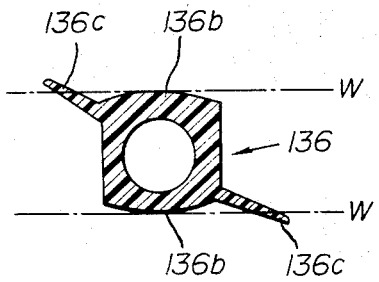
FIG. 18 is a sectional view of a first slide shoe which is a part of the slider.
Figure 19:
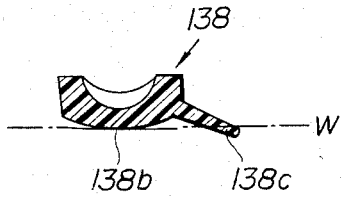
FIG. 19 is a sectional view of a second slide shoe which is also a part of the slider.
Figure 20:
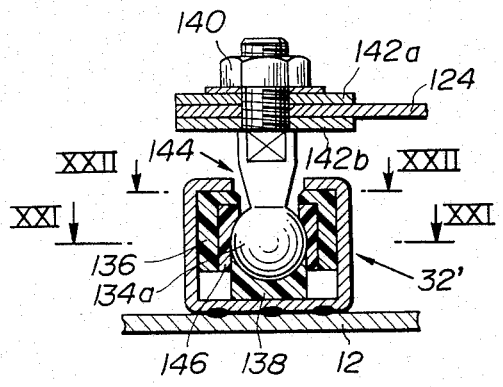
FIG. 20 is a view similar to FIG. 12, but showing a modification of the slider of the third embodiment of FIG. 12.
Figure 21:
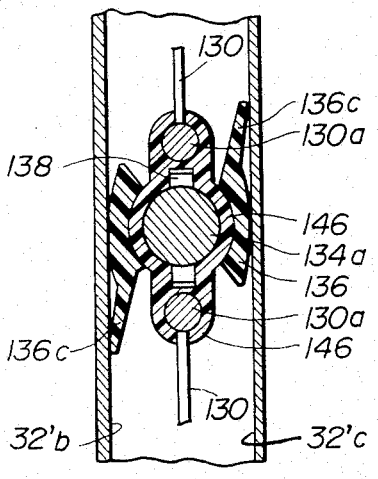
FIG. 21 is a sectional view taken along the line XXI—XXI of FIG. 20.
Figure 22:
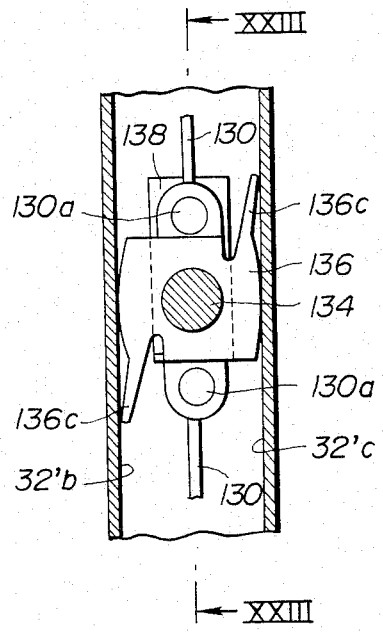
FIG. 22 is a sectional view taken along the line XXII—XXII of FIG. 20.
Figure 23:
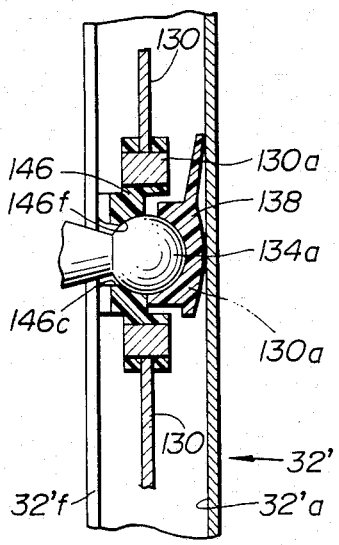
FIG. 23 is a sectional view taken along the line XXIII—XXIII of FIG. 22.

The slider 120 comprises, as is best seen in FIG. 15, a shaft 134, a first slide shoe 136 of plastics, and a second slide shoe 138 of plastics. The shaft 134 has a spherical portion 134a at its one end and a bolt portion 134b at its other end. The first and second slide shoes 136 and 138 are pivotally disposed on the spherical portion 134a of the shaft 134 in a manner as will become clear hereinafter. As is seen from FIG. 12, the shaft 134 is connected at the bolt portion 134b to the glass pane carrier 124 with aid of a nut 140. Two reinforcing plates 142a and 142b are attached to the carrier 124 for assuring the connection of the shaft 134 to the carrier 124. Upon assembly, the spherical portion 134a of the shaft 134 is received in the guide rail 32' with an interposal of the first and second slide shoes 136 and 138 therebetween.

Figure 13:
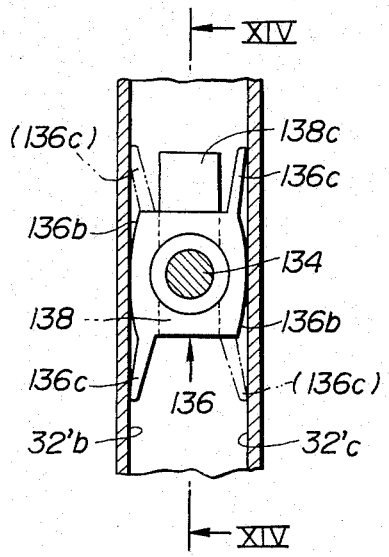
FIG. 13 is a sectional view taken along the line XIII—XIII of FIG. 12.
Figure 14:
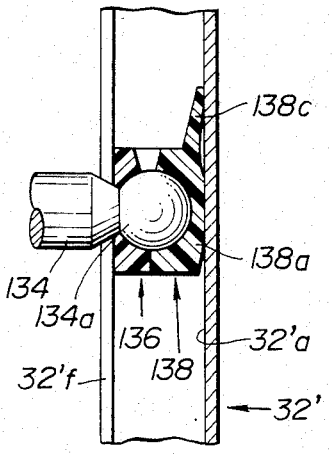
FIG. 14 is a sectional view taken along the line XIV—XIV of FIG. 13.

The first slide shoe 136 is of a symmetrical member comprising a major portion 136a having convex opposed surfaces 136b and 136b and outwardly extending tongue portions 136c and 136c. The major portion 136a is formed with a through bore including a semispherical bore section 136d (see FIG. 12) and a circular opening 136e. As is seen from FIG. 12, the diameter of the circular opening 136e is smaller than that of the semispherical bore section 136d. The first slide shoe 136 is further formed with a rectangular groove 136f into which the second slide shoe 138 is received. The second slide shoe 138 comprises a cradle-like major portion 138a having a convex surface 138b and an outwardly extending tongue portion 138c. As is seen from FIG. 15, the major portion 138a is formed with a semispherical recess 138d which registers with the spherical portion 134a of the shaft 134. As is understood from FIGS. 12, 13 and 15, upon assembly, the spherical portion 134a of the shaft 134 is almost received in the semispherical bore section 136d of the first slide shoe 136 with the head thereof received in the semispherical recess 138d of the second slide shoe 138, and at the same time, as is best seen from FIG. 12, the convex opposed surfaces 136b and 136b of the first slide shoe 136 and the convex surface 138b of the second slide shoe 138 are in sliding contact with the opposed side trucks 32'b and 32'c and the base truck 32'a of the guide rail 32'. Furthermore, as is seen from FIG. 13, the tongue portions 136c and 136c of the first slide shoe 136 are in resilient contact with the opposed side trucks 32'b and 32'c, and the tongue portion 138c of the second slide shoe 138 is also in resilient contact with the base truck 32'a. In order to provide the tongue portions of the first and second slide shoes 136 and 138 with sufficient resiliency, each tongue portion is so constructed that, under nonstressed condition, it projects beyond a tangent line W which touches the maximally raised portion of the corresponding convex surface 136b or 138b, as is understood from FIGS. 18 and 19. It is to be noted that assembly of the slider 120 to the guide rail 32' is easily achieved by putting the temporally assembled slider (that is, the temporally assembled unit comprising the shaft 134, and the first and second slide shoes 136, and 138) into the guide rail from one longitudinal open end of the same. With this, as is seen in FIGS. 13 and 14, each tongue portion 136c or 138c of the slide shoe 136 or 138 is forced to resiliently abut against the corresponding truck. If desired, one of the tongue portions 136c and 136c may be removed so long as the remaining tongue portion functions sufficiently. Furthermore, the tongue portions 136c and 136c may be provided at the opposed positions as is indicated by the broken lines in FIG. 13.

When, in operation, the manual handle 98 is manipulated to open or close the window of the door 10, the wire 130 runs in a direction to move the glass pane carrier 124 downward or upward. With this, the glass pane 18 is moved from its full-closed position to its full-open position or vice versa while swinging counterclockwise or clockwise. During this movement of the glass pane 18, the sliders 120, 118 and 122 slide in and along the corresponding guide rails 32', 30 and 34' with their first and second slide shoes being in contact with the corresponding guide trucks in such a manner as is described hereinabove.

It has been revealed that the provision of the tongue portions 136c, 136c and 138c improves the sliding characteristics of the slider 120, 118 or 122 considerably as compared with one having no tongue portion. That is, as may be seen from FIG. 17, even when the slider 120 is applied with a force from the direction "X" (that is, the direction of the width of the associated vehicle), a so-called "two-points contact" ($P_1$ and $P_2$) between the second slide shoe 138 and the base truck 32'a of the guide rail 32' can be kept due to pivotal movement of the second slide shoe 138 about the spherical portion 134a of the shaft 134. Similar to this, as may be seen from FIG. 16, even when the slider 120 is applied with a force from the direction "Y" (that is the direction of the length of the vehicle), a so-called "four-points contact" ($P_3$, $P_4$, $P_5$ and $P_6$) between the first slide shoe 136 and the side trucks 32'b and 32'c can be kept due to pivotal movement of the first slide shoe 136 about the axis of the shaft 134.

Furthermore, even when, after long use of the window regulator, the slide shoes 136 and 138 are worn out considerably particularly at the convex surfaces 136*b*, 136*b* and 138*b* thereof, the provision of the tongue portions 136*c*, 136*c* and 138*c* assures the "four-points contact" and the "two-points contact" between the shoes and the corresponding guide trucks for the same reason as is described hereinabove.

Referring to FIGS. 20 to 24, there is shown a modification of the afore-mentioned sliding mechanims of the third embodiment, which comprises a modified slider 144 and a guide rail 32'. Since the construction of the guide rail 32' is the same as that of the third embodiment of FIG. 12, the following explanation will be directed to only the modified slider 144. The parts similar to those of the above-described slider 120 are designated by the same numerals.

Figure 24:
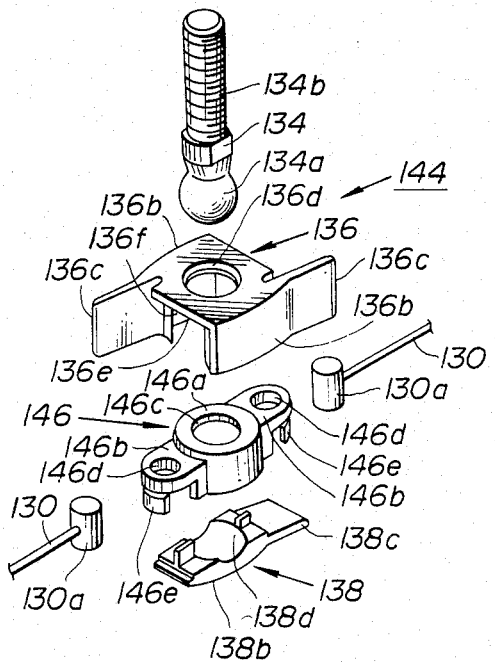
FIG. 24 is an exploded view of the modified slider.

The slider 144 which is slidably received in the guide rail 32' comprises, as is best seen in FIG. 24, a shaft 134 secured to the glass pane carrier 124 (see FIG. 20), a first slide shoe 136 of plastics, a second slide shoe 138 of plastics and an intermediate block 146 of plastics. As is seen from the drawing, the first slide shoe 136 has a construction similar to the afore-mentioned first slide shoe 136 of FIG. 15, which is thus formed with convex opposed surfaces 136*b* and 136*b* and tongue portions 136*c* and 136*c*. As may be well understood from FIGS. 21 and 24, the first slide shoe 136 is formed with a through bore which includes a cylindrical bore section 136*f* and a circular opening 136*d*. Furthermore, for the purpose which will become clear as the description proceeds, a substantially rectangular groove 136*e* (see FIG. 24) is formed in the shoe 136 to extend across the same, which is thus merged with the circular opening 136*d*. The second slide shoe 138 is also similar to the afore-mentioned second slide shoe 138 of FIG. 15, which is thus formed with a convex surface 138*b*, a tongue portion 138*c*, and a semispherical bore 138*d*. The intermediate block 146 is of a symmetrical member which comprises a cylindrical base portion 146*a* and radially outwardly extending arm portions 146*b* and 146*b*. As may be understood from FIG. 23, the base portion 146*a* is formed with a through bore which includes a semispherical bore section 146*f* and a circular opening 146*c*. The semispherical bore section 146*f* is constructed to register with the spherical portion 134*a* of the shaft 134. Each of the arm portions 146*b* and 146*b* is formed with a circular opening 146*d* and a curved lug 146*e*. The openings 146*d* and the curved lugs 146*e* are used for connecting the wire 130 to the slider assembly 144. For this connection, a connecting pin 130*a* is fixed to each end of the wire 130, as shown. As is understood from FIGS. 20 to 23, upon assembly, the intermediate block 146 is put at the cylindrical base portion 146*a* thereof in the cylindrical bore section 136*f* of the first slide shoe 136 with the arm portions 146*b* and 146*b* thereof projected in the radially opposed directions beyond the first slide shoe 136, and the shaft 134 is passed through the aligned openings 146*c* and 136*d* of the intermediate block 146 and first shoe 136 with the head of the spherical portion 134*a* thereof pivotally received in the semispherical bore 138*d* of the second slide shoe 138. As is best seen from FIG. 23, the remaining portion of the spherical portion 134*a* of the shaft 134 is also pivotally received in the semispherical bore 146*f* of the intermediate block 146. The bolt portion 134*b* of the shaft 134 is secured to the glass pane carrier 124 with aid of a nut 140, as is seen from FIG. 20. Unlike the arrangement of FIG. 11, the wire 130 is connected to the slider assembly 144. That is, the connecting pins 130*a* and 130*a* equipped to ends of the wire 130 are pivotally hooked to the openings 146*d* and 146*d* and the curved lugs 146*e* and 146*e*.

With this arrangement of the modification, substantially the same advantageous functions as those in the afore-mentioned arrangement are expected. That is, during movement of the slider 144 along the guide rail 32', the "four-points contact" is assuredly kept between the first slide shoe 136 and the side trucks 32'*b* and 32'*c* of the guide rail 32', and the "two-points contact" is also assuredly kept between the second slide shoe 138 and the base truck 32'*a* of the rail 32'. Furthermore, in this modification, the moving characteristic of the slider 144 is somewhat improved as compared with the slider 120 of FIG. 11, because the wire 130 is connected to the slider 144 directly.

What is claimed is:

1. In a door having a retractable window pane which moves between its full-open position and its full-closed position, a window regulator for regulating the movement of said window pane, comprising:

an elongate plate secured to said door, said plate being formed with a first guide rail which extends therealong;

a first slider slidably engaged with said first guide rail so that it runs along the rail;

a carrier secured to said window and mounting thereon said first slider, so that the movement of said first slider along the first guide rail induces the movement of said window pane between said full-open and full-closed positions;

guide means permitting said window pane to pivot during the movement of the same, said guide means comprising:

a second guide rail integrally formed on said elongate plate and extending therealong, said first and second guide rails extending in similar, but nonparallel, directions; and a second slider slidably engaged with said second guide rail and connected to said carrier to move therewith, said first and second sliders being connected to said carrier through respective pivot pins;

a flexible wire connected at a portion thereof to said carrier, so that the movement of said wire therealong induces the movement of said carrier and a drive unit mounted to said door and engaging the ends of said flexible wire for moving said wire therealong.

2. A window regulator as claimed in claim 1, in which said wire is connected to said carrier through a connector which is located between said first and second sliders.

3. A window regulator as claimed in claim 2, in which said wire is arranged to form a loop thereof with its both ends connected to said drive unit.

4. A window regulator as claimed in claim 3, further comprising guide tubes which cover partially said wire to guide the movement of the wire, each tube being connected to said elongate plate through a connector and extending therefrom to said drive unit.

5. A window regulator as claimed in claim 3, further comprising guide tubes which cover partially said wire to guide the movement of said wire, said tubes being connected to said elongate plate through a common connector and extending therefrom to said drive unit and further comprising a pulley rotatably connected to said elongate plate, said wire being put around said pulley.

6. A window regulator as claimed in claim 1, in which said elongate plate is formed with lug portions which are bolted to an inner panel of said door.

7. A window regulator as claimed in claim 1, in which each of said first and second guide rails comprises a first section raised perpendicularly from the major portion of the elongate plate and a second section extending perpendicularly outwardly from said first section, so that the guide rail has a generally L-shaped cross section, and in which each of said first and second sliders comprises a slotted casing pivotally connected to said carrier and a plastic slide shoe housed in said casing, said shoe being formed with a slit means the configuration of which matches with that of said guide rail, whereby upon assembly of said slider to said guide rail, said first and second sections of said guide rail are slidably received in the corresponding portions of said slit of said plastic slide shoe.

8. A window regulator as claimed in claim 7, in which said slit of said plastic slide shoe is formed with several pairs of opposed convex surfaces between which said first and second sections of said guide rail are slidably received.

9. A window regulator as claimed in claim 7, in which said plastic slide shoe is formed with locking means by which said shoe is tightly housed in said casing.

10. In a door having a retractable window pane which moves between its full-open position and its full-closed position, a window regulator for regulating the momment of said window pane, comprising:

an elongate plate secured to said door, said plate being formed with a first guide rail which extends therealong;

a first slider slidably engaged with said first guide rail so that it runs along the rail;

a carrier secured to said window and mounting thereon said first slider, so that the movement of said first slider along the first guide rail induces the movement of said window pane between said full-open and full-closed positions;

guide means permitting said window pane to pivot during the movement of the same, said guide means comprising:

a second guide rail integrally formed on said elongate plate and extending therealong, said first and second guide rails extending in similar, but non-parallel directions; and a second slider slidably engaged with said second guide rail and connected to said window pane;

a flexible wire connected at a portion thereof to said carrier, so that the movement of said wire therealong induces the movement of said carrier; and a drive unit mounted to said door and engaging the ends of said flexible wire for moving said wire therealong.

11. A window regulator as claimed in claim 10, in which said wire is connected to said carrier through a connector.

12. A window regulator as claimed in claim 11, in which said wire is arranged to form a loop thereof with its both ends connected to said drive unit.

13. A window regulator as claimed in claim 12, further comprising guide tubes which cover partially said wire to guide the movement of said wire, each tube being connected to said elongate plate through a connector and extending therefrom to said drive unit.

14. A window regulator as claimed in claim 10, in which each of said first and second guide rails is constructed to have a generally C-shaped cross section, and in which each of said first and second sliders comprises a shaft which has a spherical end and is fixed to either one of said carrier and said window pane, and first and second plastic slide shoes which are pivotally disposed on said spherical portion of the shaft, whereby upon assembly of said slider to said guide rail, said spherical portion is received in the channel of said guide rail with an interposal of said first and second slide shoes therebetween.

15. A window regulator as claimed in claim 14, in which said guide rail comprises a base truck, opposed side trucks and opposed flanges which define therebetween a longitudinally extending slot, and in which said first slide shoe is of a symmetrical member comprising a major portion having convex opposed surfaces and outwardly extending tongue portions, said convex surfaces and said tongue portions being in slidable contact with said opposed side trucks of said guide rail upon assembly of said slider to said guide rail, and in which said second slide shoe comprises a cradle-like major portion having a convex surface and an outwardly extending tongue portion, said convex surface and said tongue portion being in slidable contact with said base truck of said guide rail upon assembly of said slider to said guide rail.

16. A window regulator as claimed in claim 15, in which each of said first and second slide shoes is formed with a semispherical bore section which registers with said spherical portion of said shaft.

17. A window regulator as claimed in claim 15, further comprising an intermediate block of plastics which is interposed between said first and second slide shoes, said intermediate block being formed with radially outwardly extending arm portions which hold pivotally ends of said wire.

18. A window regulator as claimed in claim 17, in which said intermediate block is formed with a cylindrical base portion which is received in a cylindrical bore section formed in said first slide shoe, and in which said intermediate block is further formed with a semispherical bore section which registers with said spherical end portion of said shaft.

* * * * *